United States Patent [19]

Brunisholz et al.

[11] Patent Number: 4,931,252

[45] Date of Patent: Jun. 5, 1990

[54] PROCESS FOR REDUCING THE DISPARITIES IN MECHANICAL VALUES OF TUNGSTEN-NICKEL-IRON ALLOYS

[75] Inventors: Laurent Brunisholz, Saint Pierre en Faucigny; Guy Nicolas, Bonneville, both of France

[73] Assignee: Cime Bocuze, Paris la Defense, France

[21] Appl. No.: 199,913

[22] Filed: May 27, 1988

[30] Foreign Application Priority Data

Jun. 23, 1987 [FR] France ..... 87 09169

[51] Int. Cl.[5] ..... B22F 1/00

[52] U.S. Cl. ..... 419/23; 419/31; 419/32; 419/62; 75/248

[58] Field of Search ..... 419/31, 32, 62, 23; 75/248

[56] References Cited

U.S. PATENT DOCUMENTS 3,888,636 6/1975 Sczerenie et al. ..... 29/182
3,979,209 9/1976 Snyder et al. ..... 75/227
3,979,234 9/1976 Northcutt, Jr. et al. ..... 148/126
3,988,118 10/1976 Grierson et al. ..... 75/248
4,762,559 8/1988 Penrice et al. ..... 75/248

FOREIGN PATENT DOCUMENTS 0183017 6/1986 European Pat. Off. .

*Primary Examiner*—Stephen J. Lechert, Jr.
*Assistant Examiner*—Nina Bhat
*Attorney, Agent, or Firm*—Oblon, Spivak, McClelland, Maier & Neustadt

[57] ABSTRACT

A process for reducing disparities of mechanical properties in tungsten-nickel-iron alloys containing in % by weight 85 to 99% of tunsten, 1 to 10% of iron, the alloys being obtained from tungsten, nickel and iron powders which have the same or different grain diameter, shape and size distribution, which entails simultaneously adding an effective amount of each of cobalt and manganese powders to tungsten powder or to a mixture of tungsten, nickel and iron powders.

8 Claims, 5 Drawing Sheets

Figure 1A:
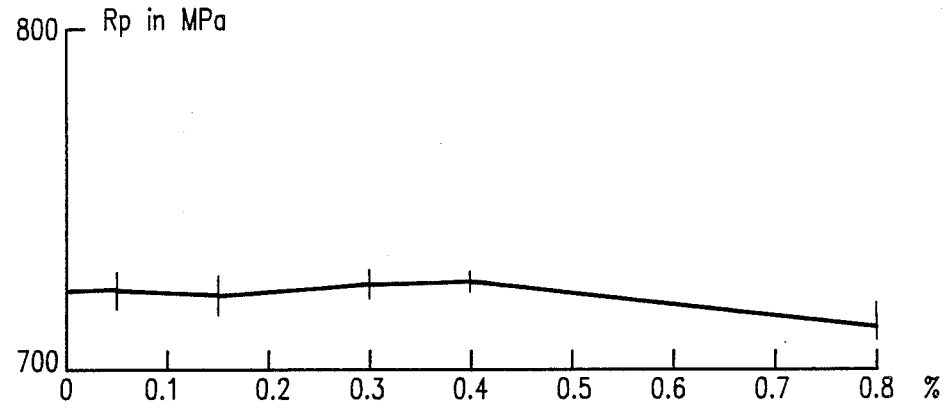

PROCESS FOR REDUCING THE DISPARITIES IN MECHANICAL VALUES OF TUNGSTEN-NICKEL-IRON ALLOYS

The present invention relates to a process for reducing the dispersion of the values of the mechanical characteristics of tungsten-nickel-iron alloys.

The Expert knows that materials intended for producing counterweights, radiation and vibration absorption devices and projectiles with a high perforating capacity must have a relatively high specific gravity.

Thus, in the production thereof use is made of so-called "heavy" alloys, which mainly contain tungsten homogeneously distributed in a metal matrix generally formed by bonding elements such as nickel and iron. Such an alloy is described in U.S. Pat. No. 3,888,636. These alloys are essentially obtained by powder metallurgy, i.e. their components are brought into the pulverulent state, compressed in order to give them the appropriate shape, sintered and optionally subject to thermal and mechanical treatments, in order to obtain products having the desired values with regards to the mechanical characteristics, such as the breaking strength, yield strength, elongation and hardness.

However, it is found that these characteristics can differ from one alloy batch to the next and can even differ significantly from the desired values.

A detailed study of these phenomena enabled the Applicant to demonstrate that this dispersion was essentially due to two factors. The first factor is the characteristics of the tungsten powders, such as their diameter, shape and grain size distribution, which vary considerably as a function of their production conditions. Thus, particularly during the compression of the powders, these variations lead to products with different apparent densities, whose behaviour changes during subsequent treatments. Thus, there are disparities with respect to the mechanical characteristics of the alloys obtained in this way. This is why in certain manufacturing cycles the treatment conditions are modified as a function of the characteristics of the powders. Although this procedure is effective, it requires additional checks and inspections and also an adaptation of the manufacturing equipment to each cycle. This dispersion is also due to the treatment conditions of the powders. Thus, the Expert knows that variations of ±20° C. on the standard sintering temperature and displacement speed variations of the products in the treatment furnaces of a few millimeters per minute lead to significant fluctuations in the mechanical characteristics. Thus, any decrease in the speed has the effect of decreasing the strength and hardness.

Any reduction in the temperature of about 20° C. has particularly unfavorable consequences on the elongation. Although this variation is not very probable with regards to the indicated or displayed temperature, this is not the case with products moved at an excessive speed through the sintering furnaces, because they fail to undergo all the thermal exchanges along the furnace. However, it is not easy on an industrial scale to fully master these speed variations or even to be sure that for a temperature indicated on the furnace, the latter always corresponds to the same thermal profile within the furnace, because the thermal insulation capacity of the linings and the gaseous atmospheres of the furnaces evolve over time.

It is to obviate these difficulties that the Applicant has developed a process making it possible to reduce the dispersion of the mechanical characteristics of W-Ni-Fe alloys obtained from powders having different characteristics and exposed to fluctuating treatment conditions and without it being necessary to carry out modifications with respect to the actual treatment conditions.

This process is characterized in that cobalt and manganese powders are added in synchronized manner to the initial powder.

Figure 1B:
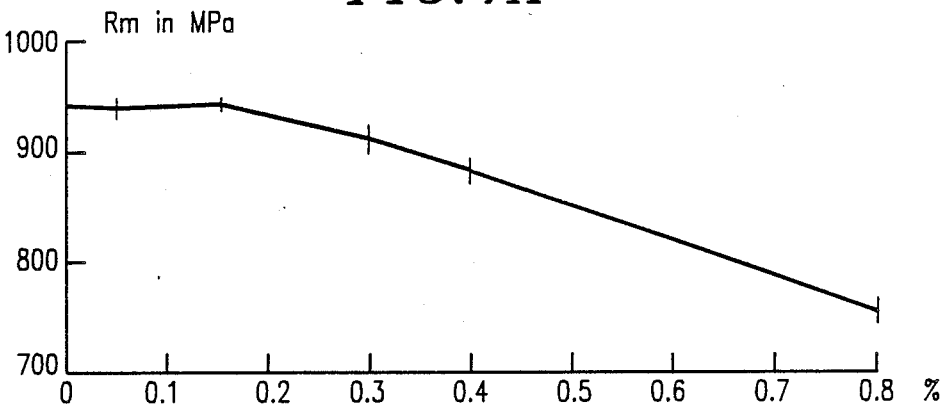
Figure 1C:
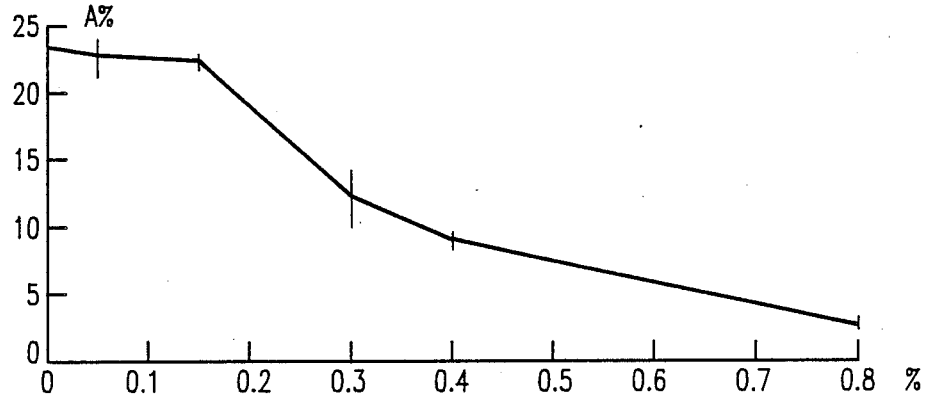

Thus, the invention consists of solely "doping" the powder containing in % by weight between 85 and 99 of tungsten, 1 to 10 of nickel and 1 to 10 of iron, with a synchronized edition of cobalt powder and manganese powder, bearing in mind that cobalt alone is an embrittling agent for such alloys, which leads to ductility losses, as is shown in FIG. 1, which represents as a function of the weight % cobalt content of the powder, the values in MPa of the breaking strength, the yield strength and the elongation of the corresponding alloys.

Said doping can be carried out by mixing, either at the time when the nickel and iron are added to the tungsten, or subsequently. It is carried out with the aid of any known mixer. The added powders have a grain size similar to that of the tungsten powder, i.e. between 1 and 15 μm FISHER and preferably between 3 and 6 μm in order to have better mechanical characteristics. Preferably the added powder quantity is such that the final powder contains in % by weight between 0.02 and 2 of cobalt and between 0.02 and 2 of manganese.

The doped powder is then subject to the following operations:

- compression in the form of products with appropriate dimensions by means of an isostatic or uniaxial press,
- sintering of the products in a pass furnace at a temperature between 1000° and 1700° C. for between 1 and 10 hours, whereby said operations can optionally be followed, as a function of the intended use of the products, by treatments such as:
- degassing the sintered products by maintaining under a partial vacuum for 2 to 20 hours at between 700° and 1300° C.,
- working approximately 5 to 20% of the degassed products and
- tempering the products by heating under partial vacuum for 2 to 10 hours at between 300° and 1200° C.

It is then found that the addition of cobalt and manganese virtually makes it possible to smooth the effects due to the different characteristics of the powders and to the fluctuations in the treatment conditions, whilst still increasing the hardness and ductility of the thus obtained alloys. This also makes it possible to widen the operating ranges of the furnaces with regards to their temperature and the displacement speed of the products.

The invention is illustrated with the aid of the following application examples, whose results appear in the attached FIGS. 2, 3, 4 and 5.

Four tungsten powder batches of different origins and designated 1, 2, 3 and 4 and each containing 4.5% nickel and 2.5% iron were in each case distributed into two parts. One part was doped in accordance with the invention with 1% by weight cobalt and 1% by weight manganese and the two parts then underwent the operation and treatments described hereinbefore under the same conditions.

Figure 2A:
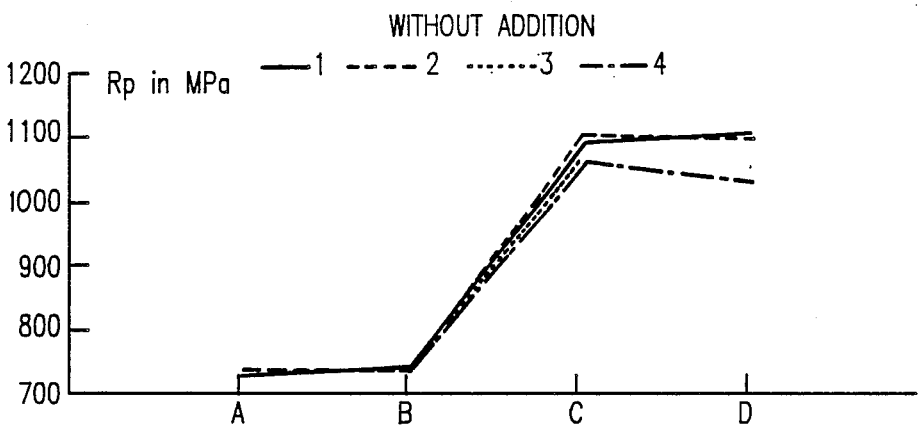
Figure 2B:
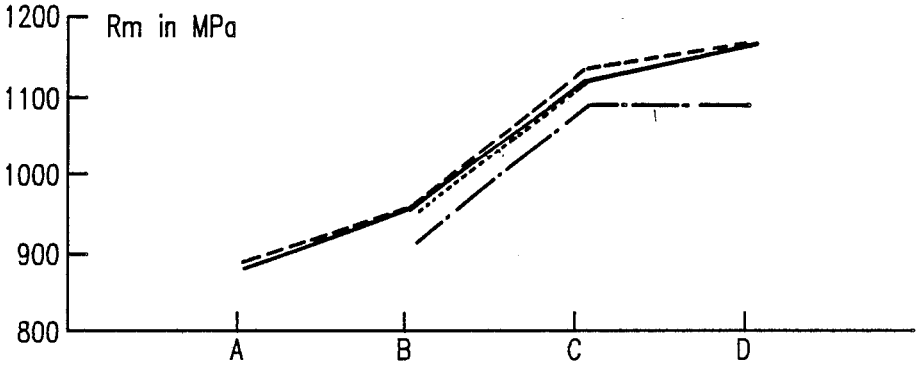
Figure 2C:
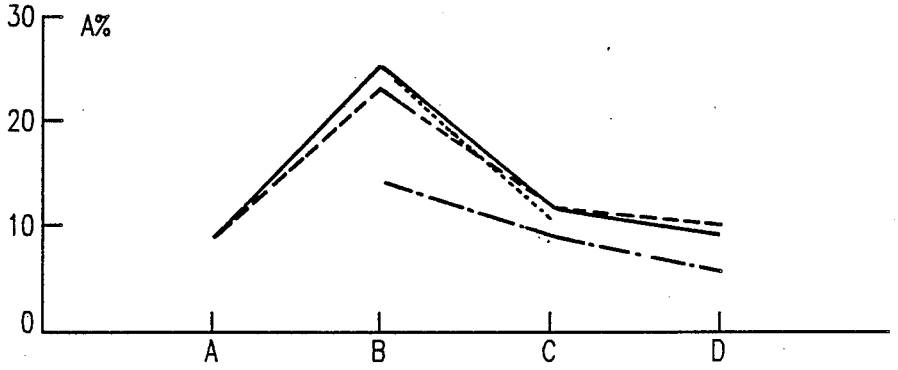
Figure 3A:
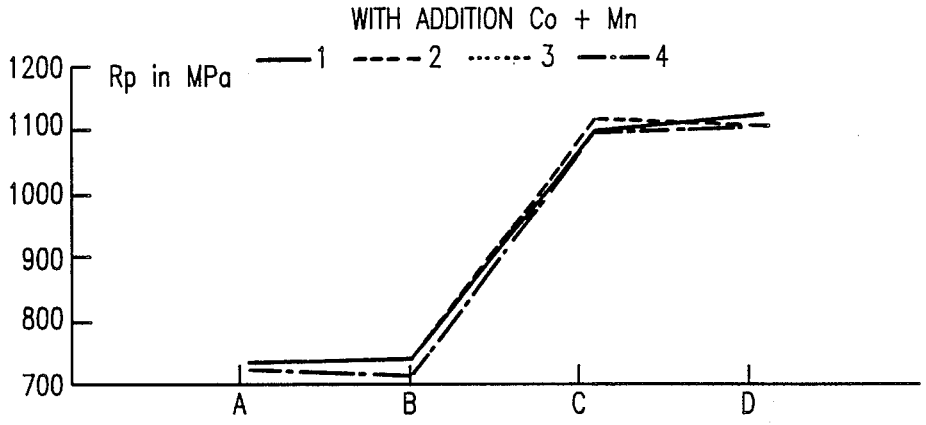
Figure 3B:
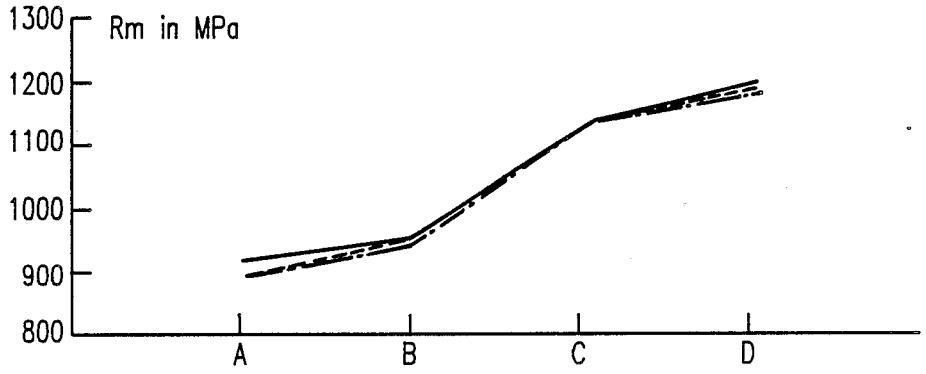
Figure 3C:
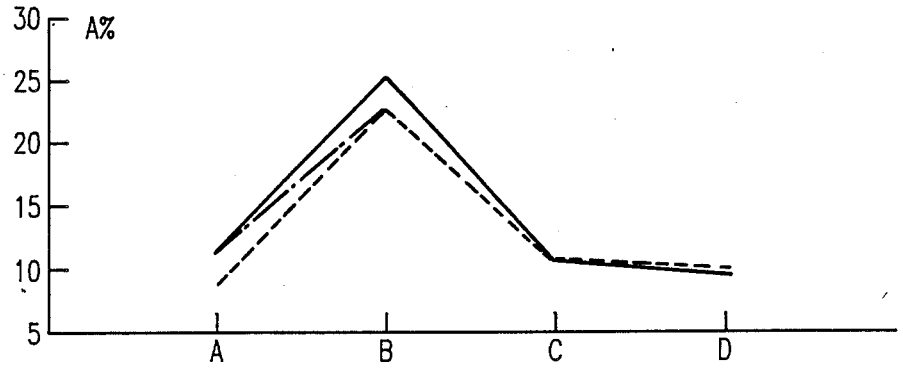

The yield strength Rp, breaking strength Rm and percentage elongation A were measured on the products following each of the following stages: sintering, degassing, working and tempering, designated by the letters A, B, C and D in FIGS. 2 and 3.

FIG. 2, which relates to the prior art alloys, shows a dispersion of the values measured on each of the products, particularly with regards to powder 4.

FIG. 3, relative to the alloys according to the invention, shows a regrouping of the values and substantially an identity of these values at the final stage of the elaboration of the alloy. These results show that it is possible to get round the problem of the origin of the tungsten powders used.

Moreover, the final value of the mechanical characteristics of the doped alloys corresponds essentially to the final value of the undoped powder with the best characteristics, namely:

| | | |
|---|---|---|
| Rp ≃ 1 100 MPa | Rm ≃ 1 050 MPa | A % ≃ 8 |

In another series of tests, use was made of a powder batch with the same composition as hereinbefore and which was subdivided into two parts, one being undoped and designated a and the other doped according to the invention and designated b. The two parts were in each case divided into 9 fractions 1 to 9. Each fraction underwent the treatments described hereinbefore, but the sintering conditions were different for each of the 9 fractions, but being identical for fractions a and b carrying the same reference.

These differences in the sintering conditions performed in a pass furnace on the one hand relate to the temperature of the furnace discharge zone for which three different values were chosen, namely the conventional sintering temperature of approximately 1550° C., a low temperature of approximately 1530° C. and a high temperature of approximately 1570° C. and on the other hand the speed at which the products pass through the sintering furnace for which three different values were chosen, namely a standard speed of 17 mm/min, a low speed of 11 mm/min and a high speed of 26 mm/min.

The temperature and speed conditions for each of the fractions are indicated in the following table.

| Fraction Reference | Temperature in °C. | Speed mm/min |
|---|---|---|
| 1a–1b | | 11 |
| 2a–2b | 1550 | 17 |
| 3a–3b | | 26 |
| 4a–4b | | 11 |
| 5a–5b | 1530 | 17 |
| 6a–6b | | 26 |
| 7a–7b | | 11 |
| 8a–8b | 1570 | 17 |
| 9a–9b | | 26 |

On each of the alloys obtained after tempering, the breaking strength Rm was measured in MPa, the yield strength Rp 0.2 in MPa, the Vickers hardness in HV30 and the elongation in %.

Figure 4:
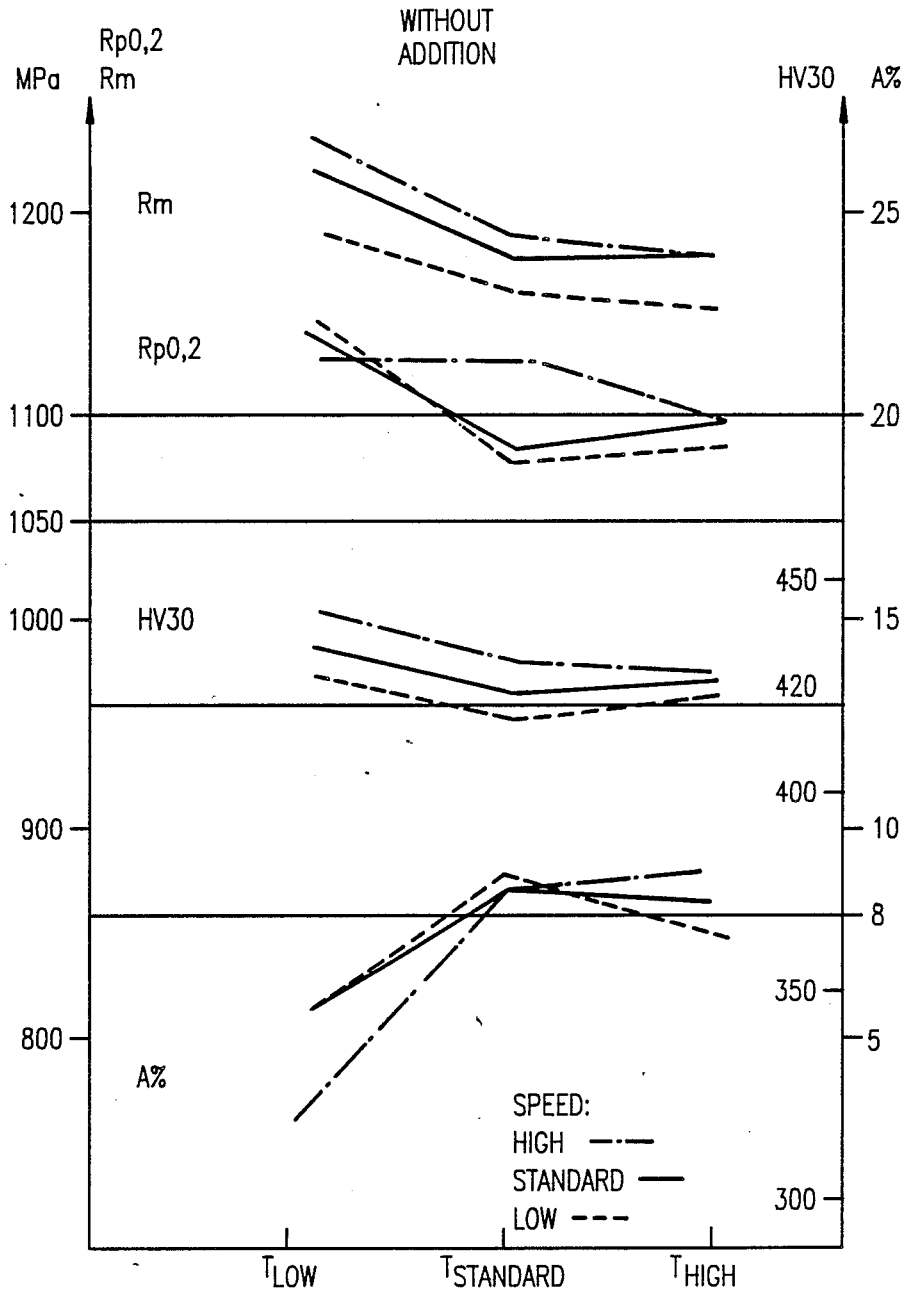
Figure 5:
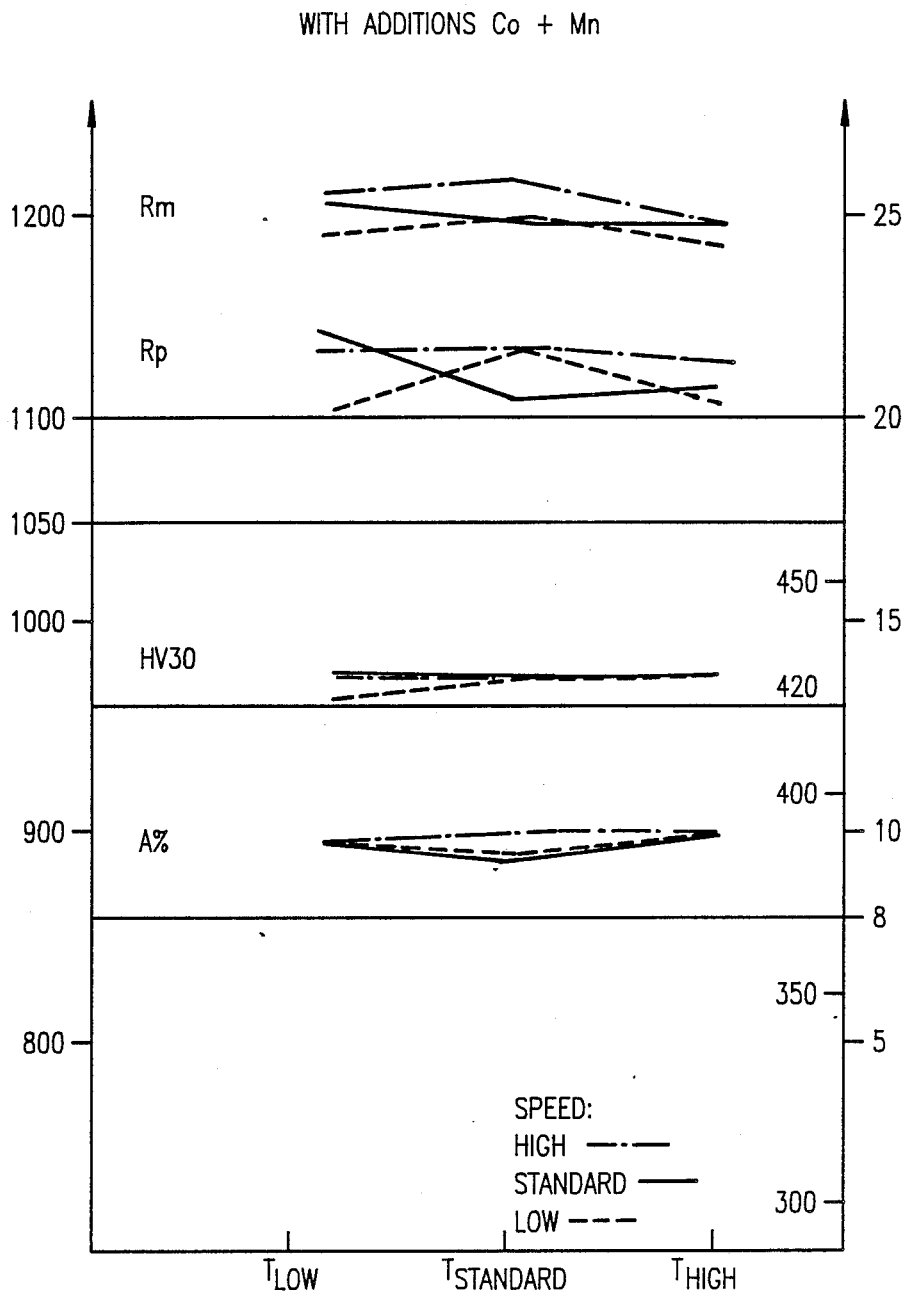

The results appear in FIG. 4 for the undoped fractions a and in FIG. 5 for the doped fractions b. It can be seen that the speed and temperature differences lead, in the case of the undoped products, to a significant dispersion in the mechanical characteristics. However, in the case of the doped products, there is a regrouping of the yield strength and breaking strength values and almost an identity of the hardness and elongation values. Moreover, the hardness and elongation values are significantly improved, no matter what the speed.

Thus, the interest of the invention is readily apparent and apart from eliminating the aforementioned dispersions, it makes it possible to improve the values of certain characteristics by getting round the problem of the different speeds and temperatures, which gives more flexibility in the production cycles, in the requirements for the production equipment and also makes it possible to envisage increasing the production capacities, due to the possible increase in the displacement speeds of the products in the furnaces.

We claim:

1. A process for reducing disparities of mechanical properties in tungsten-nickel-iron alloys containing in % by weight 85 to 99% of tungsten, 1 to 10% of nickel and 1 to 10% of iron, said alloys being obtained from tungsten, nickel and iron powders which have the same or different grain diameter, shape and size distribution, which comprises simultaneously adding an effective amount of each of cobalt and manganese powders to tungsten powder or to a mixture of tungsten, nickel and iron powders.

2. The process according to claim 1, wherein the quantity of added powers leads to a final powder containing in % by weight between 0.02 and 2% of cobalt and between 0.02 and 2% of manganese.

3. The process according to claim 1, wherein the FISHER grain size of the added powders is between 1 and 15 μm.

4. The process according to claim 3, wherein the grain size is between 3 and 6 μm.

5. A process of making tungsten-nickel-iron alloys having a reduced disparity of mechanical properties, said alloys containing in % by weight 85 to 99% of tungsten, 1 to 10% of nickel and 1 to 10% of iron, which comprises simultaneously mixing an effective amount of each of cobalt and manganese powders with tungsten powder or with a mixture of tungsten, nickel and iron powders having the same or different grain diameter, shape and size distribution; and subsequently heat treating said mixed powder to form said alloys.

6. The process according to claim 5, wherein the quantity of added powders leads to a final powder containing in % by weight between 0.02 and 2% of cobalt and between 0.02 and 2% of manganese.

7. The process according to claim 5, wherein the FISHER grain size of the added powders is between 1 and 15 μm.

8. The process according to claim 7, wherein the grain size is between 3 and 6 μm.

* * * * *